US005523764A

United States Patent [19]

Martinez et al.

[11] Patent Number: 5,523,764

[45] Date of Patent: Jun. 4, 1996

[54] ELECTRONIC BEAM STEERING OF ACTIVE ARRAYS WITH PHASE-LOCKED LOOPS

[75] Inventors: René D. Martinez; Richard C. Compton, both of Ithaca, N.Y.

[73] Assignee: Cornell Research Foundation Inc., Ithaca, N.Y.

[21] Appl. No.: 294,006

[22] Filed: Aug. 23, 1994

[51] Int. Cl.[6] ..... H01Q 3/22

[52] U.S. Cl. ..... 342/372

[58] Field of Search ..... 342/368, 371, 342/372, 375

[56] References Cited

U.S. PATENT DOCUMENTS 3,484,784 12/1969 McLeod .
4,313,220 1/1982 Lo et al. .
4,367,542 1/1983 Dubroff ..... 367/48
4,368,469 1/1983 Ott et al. .
4,408,205 10/1983 Hockham .
4,747,160 5/1988 Bossard .
5,274,844 12/1993 Harrison et al. .

*Primary Examiner*—Gregory C. Issing
*Attorney, Agent, or Firm*—Jones, Tullar & Cooper

[57] ABSTRACT

An electronic beam steering technique for active arrays uses a single balanced diode mixer phase-locked loop connected between adjacent oscillators. Each oscillator has its own antenna that radiates energy into free space so the phase difference between oscillators determines the direction of the main radiating beam. An offset voltage added to the phase-locked loop controls the phase difference and thus the beam direction, providing over 100° of adjustable phase difference between adjacent oscillators.

14 Claims, 4 Drawing Sheets

ELECTRONIC BEAM STEERING OF ACTIVE ARRAYS WITH PHASE-LOCKED LOOPS

BACKGROUND OF THE INVENTION

The present invention relates, in general, to active antenna arrays, and more particularly to an improved beam steering technique for such arrays.

In radio frequency communication systems such as radar, wireless telecommunication, or the like, it is desirable to direct electromagnetic radiation from a transmitter to a target with the greatest efficiency possible, not only to reduce the required power, thereby reducing expense, but also to prevent interference. In radar applications, it is known to focus radiation from an array of antennas into a beam to illuminate an object to thereby generate a reflected signal. A high power source is required for this, with motor drives or multiple phase shifters being required to scan the antennas and the beam through a predetermined angle.

In wireless telecommunications, such as mobile telephones, arrays of antennas such as those used with radar have not been practical, with the result that omni directional antennas, which have a transmission pattern of about 360° around the antenna, are generally used. Although such antennas do not require beam scanning, and thus are able to communicate with a plurality of receivers or with a single receiver having a location which changes as the mobile transmitter moves with respect to it, they experience significant difficulties. Not only does the need to transmit in all directions reduce the effective power available to be received by a particular receiver, but with multiple receivers, cell to cell interference can present a significant problem. Furthermore, an antenna which radiates in all directions may present a hazard to the user of the equipment who is exposed to the electromagnetic radiation.

In order to reduce cell-to-cell interference, to improve safety, and to reduce the amount of power required to drive the antenna, a directional antenna focusing the transmitted beam to the selected receiver would be required. Directional antennas are known, and typically have a 60° wide transmission pattern, but such antennas are not practical in a moving vehicle, for example, which is moving with respect to the receiver location. A rotatable directional antenna would be required in such a situation to track the receiver, but such antennas present both mechanical and electrical problems.

The need to mechanically rotate an antenna, for example, introduces the requirement for a drive motor and its controls. These not only increase the cost of the unit, but are highly undesirable in, for example, an automobile or other small vehicle from which such transmissions are to be made. Furthermore, a rotary antenna present electrical problems in that it is difficult to maintain a reliable electrical connection between the stationary and the rotating components. Because of these practical difficulties, the users of mobile telecommunications equipment have had to continue the use of omnidirectional antennas, and to accept the consequent problems presented by cell-to-cell interference, and have had to accept relatively low power levels in order to prevent possible injury to users of the equipment, thereby reducing the effective range of such equipment. However, the need for a steerable, directional antenna without mechanical rotators to reduce the power required for such equipment, to reduce the exposure of nearby people to radiation, and to overcome cell-to-cell interference still exists.

An active quasi-optical array is an ensemble of antennas and active devices which are integrated into a planar substrate. Such arrays are well known with each active device having its own antenna that radiates energy into free space. Although most of the research on active arrays has concentrated on obtaining a fixed beam, these quasi-optical arrays are similar to antenna arrays in that the phase difference between active devices, or between antennas, determines the direction of the main radiating beam. Various techniques based on optics or electronics have demonstrated some control over the phase difference between oscillators in such active arrays. Thus, one way to steer a beam in an active array is to apply a signal with a differential phase difference between the ends of the array. (See K. D. Stephan and W. A. Morgan, "Analysis of Inter-Injection-Locked Oscillators for Integrated Phased Arrays", *IEEE Transactions on Antennas and Propagation,* Vol. AP-35, pp. 771–1084, July 1987.) In such an array, if all of the interior oscillators have the same frequency, then the phase difference applied between the ends of the array evenly distributes over the array. Thus, if there are n interior oscillators in a linear array, and if a signal having a phase difference of $\phi$ is applied to the ends of the array, the phase difference between adjacent oscillators is $\phi/(n+1)$. In such an array, the maximum phase difference between the ends is limited to $\pm 180°$, so as the number of oscillators increases the maximum phase difference between adjacent oscillators decreases to 0.

Another technique is similar to the foregoing but offers an improved adjustable phase difference by injecting a frequency difference (rather than a phase difference) at the ends of the array. (See, for example, P. Liau and R. A. York, "A New Phase-Shifterless Beam-Scanning Technique Using Arrays of Coupled Oscillators", *IEEE Transactions on Microwave Theory and Techniques, Special Issue on Quasi-Optical Techniques,* October 1993.) In such a technique, the frequencies of the two oscillators at the ends of the array are set differently than the interior oscillators. However, the end oscillators will lock in at the same frequency as the interior oscillators, and the entire chain of oscillators will operate at the same frequency. The end oscillator which is set at a higher frequency tends to pull the chain along toward the higher frequency, whereas the end oscillator set at a lower frequency tends to drag the chain down in frequency. This pulling and dragging causes a phase lead and lag, respectively, between adjacent oscillators along the array which can continue until the end oscillators break away from the interior oscillators and start operating at different frequencies.

Although both techniques have benefits because of their simplicity, the synchronization of the set frequency, sometimes less than 1 MHz out of 10 GHz, of an oscillator array is difficult. In addition, these techniques both assume uniform energy exchange between neighboring oscillators, but to assure this, is necessary to provide additional circuitry which complicates the array.

SUMMARY OF THE INVENTION

The present invention is directed to an active antenna array which includes a plurality of antennas, with each having its own oscillator for radiating energy into free space. Each oscillator may operate at a microwave frequency; for example, 10 GHz, although any radio frequency may be used. A phase-locked loop (PLL) between each adjacent pair of oscillators maintains, or locks-on, a fixed phase difference between them, each PLL using a feedback system to force one oscillator to track the frequency of the other, adjacent oscillator. When this occurs, a phase difference appears between the oscillators, and this phase difference controls the direction of the resultant beam transmitted by both antennas. A direct current or low frequency offset voltage can be injected into the loop to control the phase difference at which the adjacent oscillators synchronize in frequency, and since the phase difference determines the direction of radiation, varying the offset bias changes the direction of the beam. In a preferred form of the invention, the array of antennas and active devices are integrated into a planar substrate, making the array suitable for use in conjunction with mobile telecommunication systems.

BRIEF DESCRIPTION OF THE DRAWINGS

The foregoing, and additional objects, features, and advantages of the present invention will become apparent to those of skill in the art from a consideration of the following detailed description of preferred embodiments thereof, taken in conjunction with the accompanying drawings, in which.

DESCRIPTION OF PREFERRED EMBODIMENTS

Figure 1:
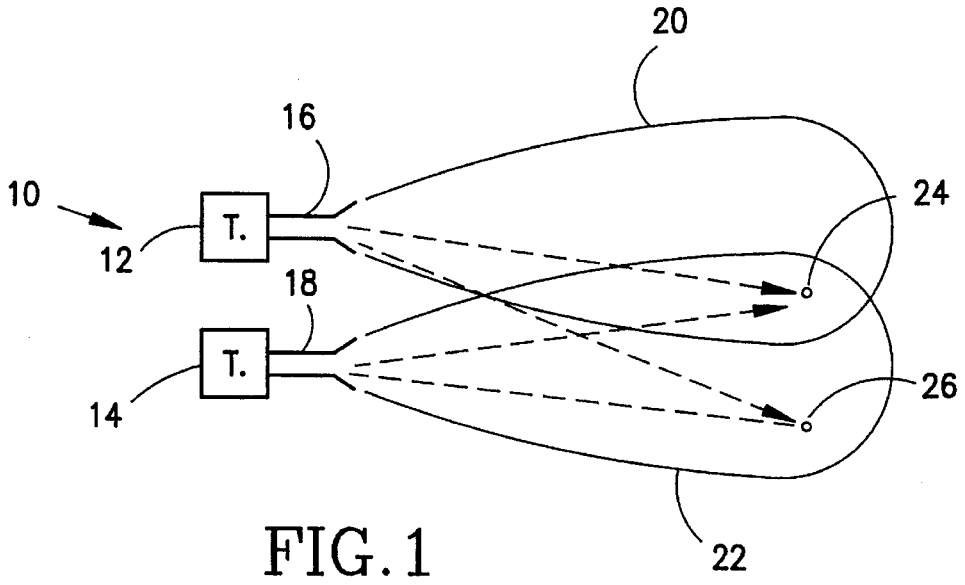
FIG. 1 is a diagrammatic illustration of beam steering in an antenna array.

Turning now to a more detailed consideration of the present invention, there is illustrated in FIG. 1 in diagrammatic form an antenna array 10 which consists of, for example, a pair of transmitters 12 and 14 each incorporating a corresponding antenna, transmitter 12 driving antenna 16 and transmitter 14 driving antenna 18. The antennas preferably are directional, transmitting in a 60° cone, with the antennas transmitting corresponding beams 20 and 22 which overlap at a target region 24 which is equidistant from the two antennas. The antenna beams are in phase and constructively interfere at 24; however, there is no constructive interference at other areas, such as target area 26, where the distances from antennas 16 and 18 are unequal. As a result, a directional pattern is produced by the array 10, but this pattern is not steerable; accordingly, this type of array is not suitable for mobile telecommunications.

By varying the relative phase of the signals transmitted by antennas 16 and 18 the direction of the resultant beam can be shifted, for example, from region 24 to region 26, thereby providing a phased array. The present invention is directed to a low-cost active phased array utilizing phased locked loop (PLL) circuitry, as generally illustrated at 28 in FIG. 2. As there illustrated, a first antenna 30 is driven, through a suitable coupler 32, by a reference oscillator 34 which may operate, for example, at 10 GHz to cause the antenna 30 to transmit a microwave directional beam 36. A second antenna in the array 28 is illustrated at 38 and is driven, through a coupler 40, by a voltage controlled oscillator 42. The oscillator 34, coupler 32 and antenna 30 make up a first transmitter generally indicated at 50, while voltage controlled oscillator 42, coupler 40, and antenna 38 make up a second transmitter generally indicated at 52.

The adjacent transmitters 50 and 52 are coupled by a phase locked loop circuit 54 which includes a mixer 56 to which a portion of the power supplied to each of the antennas 30 and 38 is directed by way of lines 58 and 60, respectively. Most of the power from each oscillator is delivered to its corresponding antenna to produce the beams 36 and 44, while a fraction of the power from each is delivered to drive the mixer 56. Since the signal on line 58 is derived from the reference oscillator 34, it may be referred to as a local oscillator (LO) signal, while the signal on line 60, which represents the output of the voltage controlled oscillator 42, may be referred to as the radio frequency (RF) signal.

The output $V_{IF}$ of the mixer 56 is supplied by way of line 62 to an adder 64. When the oscillators 34 and 42 operate at the same frequency, the average output voltage $V_{IF}$ produced by the mixer 56 on line 62 depends upon the phase difference $\phi$ between the oscillators, and may be described as follows:

$$V_{IF} = K_\phi \sin \phi \qquad \text{(Eq. 1)},$$

where $K_\phi$ is a constant that depends on the mixer and on the RF power on line 60.

Also supplied to adder 64 by way of input line 66 is an offset voltage $V_{off}$, which is the control voltage for regulating the phase difference between the reference oscillator 34 and the voltage control oscillator (VCO) 42. The output $V_{tune}$ of the adder 64 is a dc control voltage supplied by way of line 68 to the VCO to regulate the frequency f of the oscillator 42 in accordance with the following:

$$f_{vco} = K_{vco}(V_{IF} - V_{off}) + f_{REF} \qquad \text{(Eq. 2)}$$

Where $K_{vco}$ is a constant that depends on the VCO 42, and $f_{REF}$ is the frequency of reference oscillator 34. The tuning voltage $V_{tune}$ on line 68 may be expressed as follows:

$$V_{tune} = V_{IF} - V_{off} = K_\phi \sin \phi - V_{off} \qquad \text{(Eq. 3)}$$

Eq. 3 can then be rewritten to explicitly state the phase dependance on the PLL voltages as follows:

$$\phi = \sin^{-1} \frac{V_{tune} + V_{off}}{K_\phi} \qquad \text{(Eq. 4)}$$

Where $\phi$ is the phase difference between oscillators 34 and 42. It will be seen from the foregoing that when $V_{off}$ and $V_{tune}$ are both equal to 0, then the phase of oscillator 34 is the same as the phase of oscillator 42, and both oscillators operate at the same frequency f.

When the phase loop remains locked; i.e., when the frequency of the voltage controlled oscillator 42 matches the frequency of reference oscillator 34, the tuning voltage $V_{tune}$ on line 68 remains constant. However, the relative phases of the two oscillators can be varied by changing the tuning voltage $V_{tune}$ to shift the VCO. This is accomplished by way of an offset voltage $V_{off}$ applied to adder 64. This voltage $V_{off}$ is added to $V_{IF}$ to change the control voltage applied to voltage controlled oscillator 42, causing the oscillator to tend to change its frequency of operation. For example, a decrease in $V_{off}$ will tend to increase the frequency of operation of VCO 42. However, because of the phase locked loop 54, the frequency $f_{REF}$ of oscillator 34 has to equal the frequency $f_{vco}$ of the VCO 42. Therefore, the RF output from VCO 42 applied by way of line 60 to mixer 56 tends to change the voltage $V_{IF}$ in a direction to cause $V_{IF}-V_{off}$ to equal 0. The circuit accomplishes this by changing the phase of the VCO 42 without changing its frequency in such a way that $V_{IF}=V_{off}$, with the result that $V_{tune}=0$. The phase locked loop then stabilizes the VCO at the desired phase difference with respect to reference oscillator 34, and the phase difference between the two oscillators changes the relationship between transmitted beams 36 and 44 to produce beam steering.

The phase difference changes between oscillators 34 and 42 can be expressed as follows:

$$-K_\phi-V_{tune}\leqq V_{off}\leqq+K_\phi-V_{tune}\rightarrow-90°\leqq\phi\leqq+90° \quad \text{(Eq. 5)}$$

When the offset voltage $V_{off}$ is outside the boundaries of Eq. 5, the mixer 56 cannot compensate for the large offset voltage, and therefore cannot maintain the proper tuning voltage on VCO 42. This will result in a change in frequency in the VCO. However, within limits, the phase locked loop 54 can generate a large adjustable phase difference of up to 180° between the antennas 30 and 38.

Figure 2:
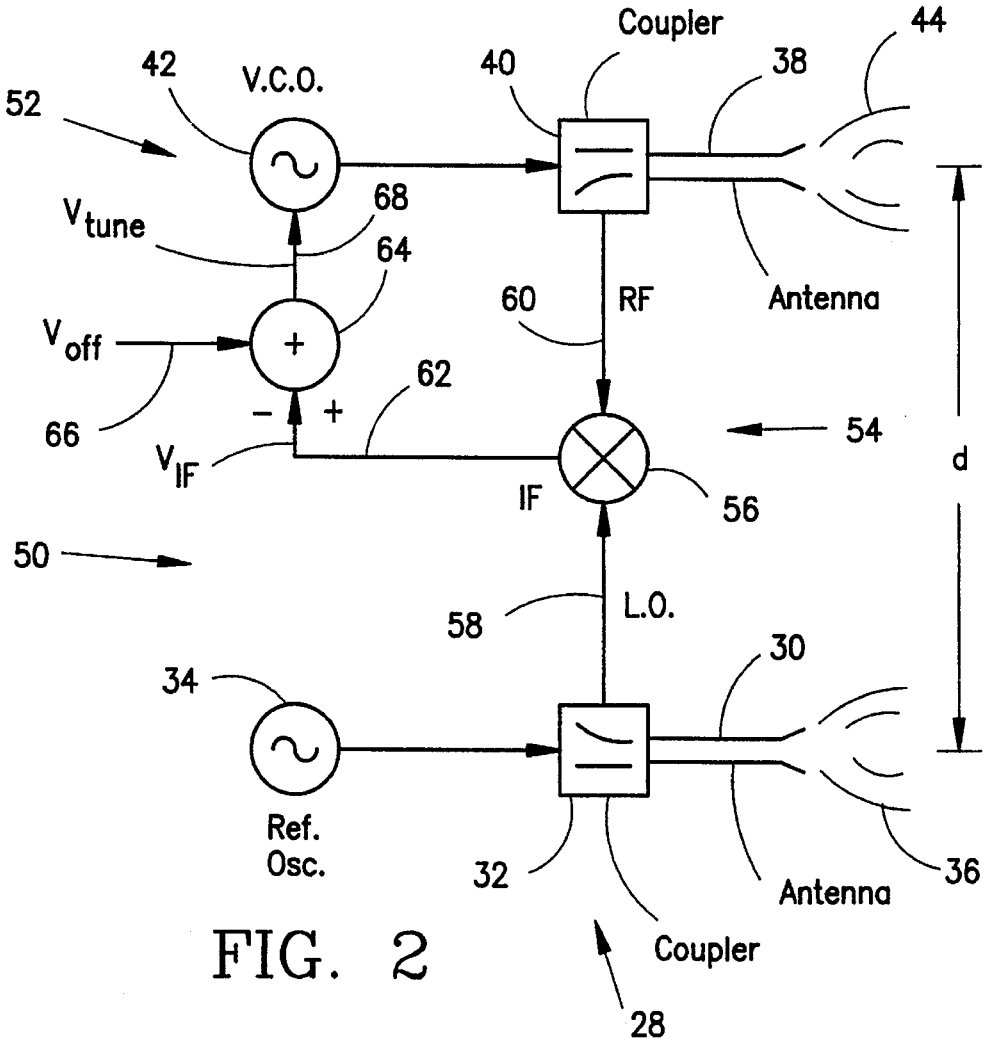
FIG. 2 is a block diagram of a two-antenna array controlled by a phase-locked loop in accordance with the present invention.
Figure 3:
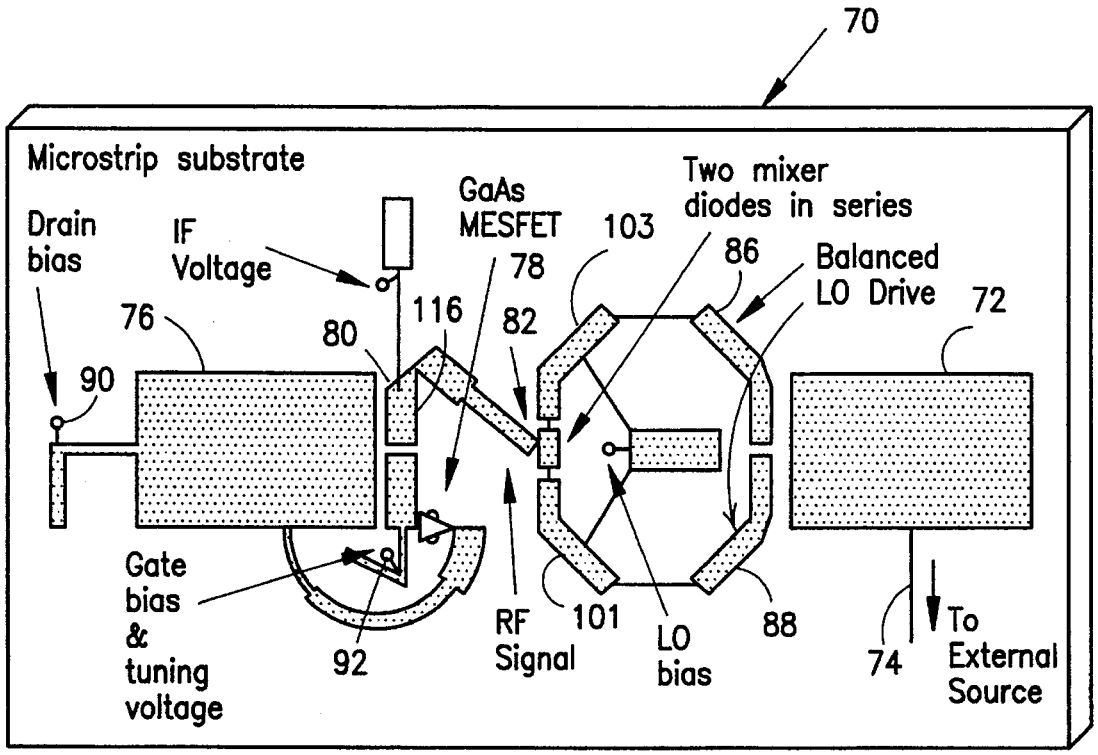
FIG. 3 is a diagrammatic top plan view of a microstrip layout of the phase-locked loop antenna array of FIG. 2.

One implementation of the phase locked loop antenna array of FIG. 2 is diagrammatically illustrated in FIG. 3, wherein element 70 is a microstrip substrate carrying an active antenna array having a reference patch, or antenna 72, corresponding to antenna 30 in FIG. 2. Antenna 72 is driven by an external source such as a fixed frequency oscillator (not shown) connected to line 74, the external source corresponding to the reference oscillator 34 in FIG. 2. A second patch 76 corresponds to the active antenna 52 of FIG. 2 and is driven by a gallium arsenide MESFET 78 configured as a voltage controlled oscillator. A 90° coupler 80 adjacent a nonratiating edge of the antenna patch 76 supplies RF signals to a mixer 82. The mixer includes a pair of series-connected mixer diodes which are connected to a pair of 90° couplers 86 and 88 which are located near the reference patch 72 to provide out-of-phase balanced signals to produce local oscillator (LO) signals in the mixer 82.

Bias circuits are provided to isolate the microwave and the DC signals. Drain and gate bias sources are supplied to terminals 90 and 92 to drive the voltage controlled oscillator and a local oscillator bias is applied to terminal 94 for the mixer. Suitable connector wires for all of the low frequency signals and the DC bias supplies pass under the substrate through via holes, in well known manner. With this layout, the active antenna patches, the voltage controlled oscillator and the phase-locked loop circuits can be easily replicated to make a larger active array.

Although a single diode mixer would be simpler, such a device has poor LO-RF isolation, and has no isolation when the LO and the RF are at the same frequency, as is the case with the present device. A high LO-RF isolation prevents the voltage controlled oscillator from injection locking to the reference oscillator, and this is critical, for injection locking may inhibit the phase-locked loop from operating properly. A balanced two-diode mixer such as that illustrated herein is more complicated but it provides the necessary isolation.

Figure 4:
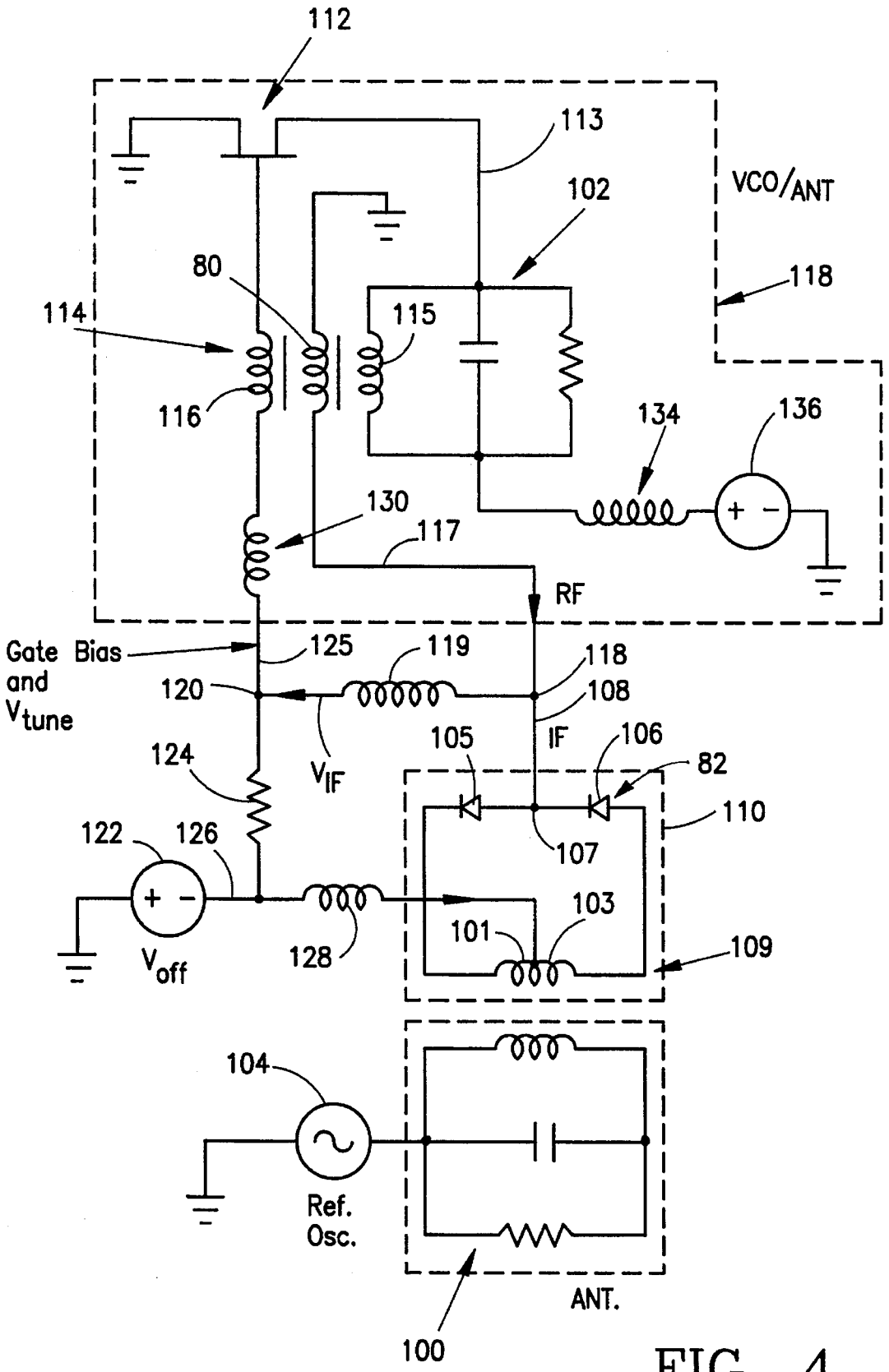
FIG. 4 is a schematic diagram of the equivalent lumped element circuit of the phase-locked loop array of FIG. 2.

The operation of the phase-locked loop system may be explained with reference to FIG. 4, which illustrates the equivalent lumped-element circuit for the microstrip structure of FIG. 3. Common elements are indicated by the same reference numeral in these two figures. In FIG. 4, the microstrip patch antennas 72 and 76 are represented by two parallel RLC circuits 100 and 102 which represent the resonance and radiation resistance of the microstrip antennas. Patch antenna 100 is driven by a reference oscillator 104 and produces, on the output windings 101 and 103 of a coupling transformer 109 in the antenna circuit a balanced LO output represented by the microstrip windings 86, 88, 101, and 103. The opposite ends of windings 101 and 103 are connected to series diodes 105 and 106, respectively, with the junction 107 between the two diodes being connected to an output line 108. The diodes 105 and 106 and line 108 form a mixer 110.

The patch antenna represented by RLC circuit 102 is driven by a voltage controlled MESFET 112 by way of line 113. The MESFET is in a feedback oscillator configuration with the antenna 102 by way of transformer 114 having a primary winding 115 and a secondary, feedback winding 116 connected to the base of the MESFET. Another secondary winding 80 in transformer 114 couples the antenna 102 to an output line 117 which provides an RF output from the VCO/ANT circuit 118. This RF output is supplied to the junction 109 of diodes 105 and 106 to provide an RF signal to the mixer 110. With this single balanced mixer 110, the IF provided on line 108 by diodes 105 and 106 and the RF supplied by way of line 117 are the same node at the junction 118 of lines 108 and 117. Also connected to this junction 118 is a microstrip circuit filter 119 which behaves as an RF choke to separate the low-frequency IF voltage on line 108 from the RF signal on 117. The resulting filtered voltage $V_{IF}$ is then supplied to terminal 120 to provide a tuning voltage $V_{tune}$. The IF voltage that the mixer diodes generate is relative to the LO bias, so an offset voltage $V_{off}$, supplied by source 122, which also serves as the LO bias source, is effectively added to the IF voltage from the center-tapped equivalent transformer 109 by way of diodes 105 and 106.

A low frequency high resistance resistor 124, which may be located behind the microstrip substrate 70 in FIG. 3, is connected between the offset voltage source $V_{off}$ (source 122) and the IF voltage $V_{IF}$ supplied to junction 120 to provide a DC path that prevents the RF/IF voltage from floating. The junction 120 is the gate bias terminal shown at 92 in FIG. 3, and the dc voltage at this point is the voltage $V_{tune}$ which controls the oscillator 112 frequency. Thus, in this implementation of the phase-locked loop, the IF voltage from the mixer 110 is supplied by way of choke 119 to provide the tuning voltage $V_{tune}$ on line 125 leading to the gate of VCO 112. The control or offset voltage 122 is also supplied by way of line 126 to choke 128 where it is added to the IF voltage and the LO bias voltage in mixer 110 to make up the control voltage $V_{tune}$, as discussed above.

The dc control voltage $V_{tune}$ on line 125 is supplied by way of RF choke 130 to the gate of MESFET oscillator 112, with the drain of the oscillator being connected by way of line 113 to the antenna equivalent circuit 102, as noted above. The circuit 102 is also connected through a choke 134 and through a drain bias voltage source 136 to ground. The RF chokes 128 and 130 represent microstrip filters for the LO bias 94 and the gate bias 92 of FIG. 3, respectively. The MESFET 112 is powered by the drain voltage 136, and RF choke 134 represents a microstrip filter for the drain bias 90 of FIG. 3.

The phase difference α between transmitted microwave beams 36 and 44 at a receiver depends upon the physical separation d of the transmitter antennas 30 and 38, the wavenumber k of the radiation, the angle θ of the receiver relative to the transmitter, and the phase difference φ between the antennas, which may be expressed as follows:

$$\alpha=kd\sin\theta+\phi \quad \text{(Eq. 6)}$$

When the phase difference at the receiver is 0; that is, when α= 0, the waves emanating from the antennas 30 and 38 constructively add. Assuming that the radiation pattern of the individual transmitter antennas varies slowly compared to the power change caused by the received phase difference in Eq. 6, a local maximum in received power will occur when this phase difference is 0.

Figure 5:
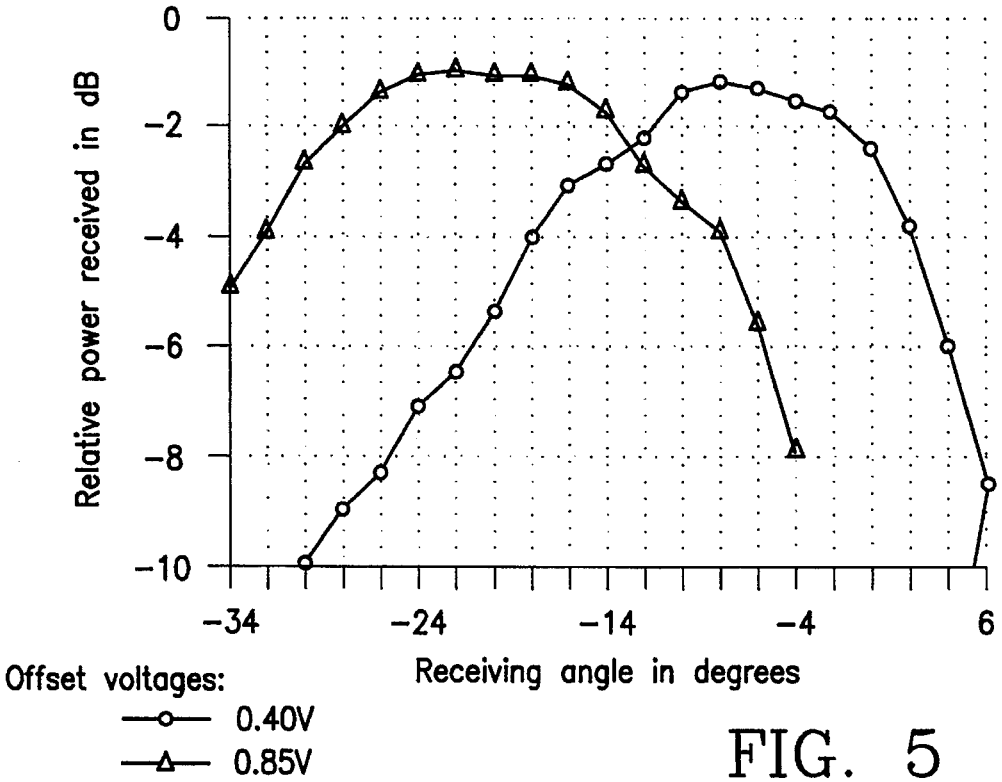
FIG. 5 is a graphical illustration of relative power received from a transmitted main radiating beam versus receiving angle as the radiating beam changes directions in response to the application of offset voltages to the phase-locked loop circuit of FIG. 2.

In FIG. 5 the received power from a main radiating beam is plotted versus the receiving angle for two different offset voltages. Thus, curve 130 shows a variation for an offset voltage $V_{off}$= 0.04 volts, while curve 132 illustrates the received power when $V_{off}$= 0.85 volts. As illustrated, as the offset voltage changes from 0.04 volts to 0.85 volts, the angle of the maximum power received moves from −7° to −22°. Two angles for the maximum power received, $\theta_1$ and $\theta_2$, are generated by two phase differences between the transmitting antennas $\phi_1$ and $\phi_2$. For both maximum power received points, the phase difference at the receiver is 0, $\alpha$= 0, and Eq. 6 can be used twice, as follows:

$$\phi_1=-kd \sin \theta_1 \quad \phi_2=-kd \sin \theta_2 \qquad \text{(Eq. 7)}$$

The adjustable range of phase difference $\Delta\phi$ for the transmitting antennas is determined by the extents of the beam steering. Subtracting the two equations in Eq. 7 gives the adjustable phase difference in terms of the beam steering angle:

$$\Delta\phi=|\phi_1-\phi_2|=kd\ |\sin \theta_2-\sin \theta_1| \qquad \text{(Eq. 8)}$$

where $\theta_1$ and $\theta_2$ are the extreme angles of maximum power received.

In the illustrated microstrip of FIG. 3, which represents a working embodiment of the invention, the separation between the patch antennas 72 and 76 is 484°, referenced to a wavelength in free space at 10 GHz. With 74 $_2$=−22°, $\theta_1$=−7°, and kd= 484°, the adjustable phase difference is $\Delta\phi$=122°, which compares favorably with the theoretical difference of 180°. The separation of patch antennas can be reduced to increase the amount of beam steering to ±90°.

Figure 6:
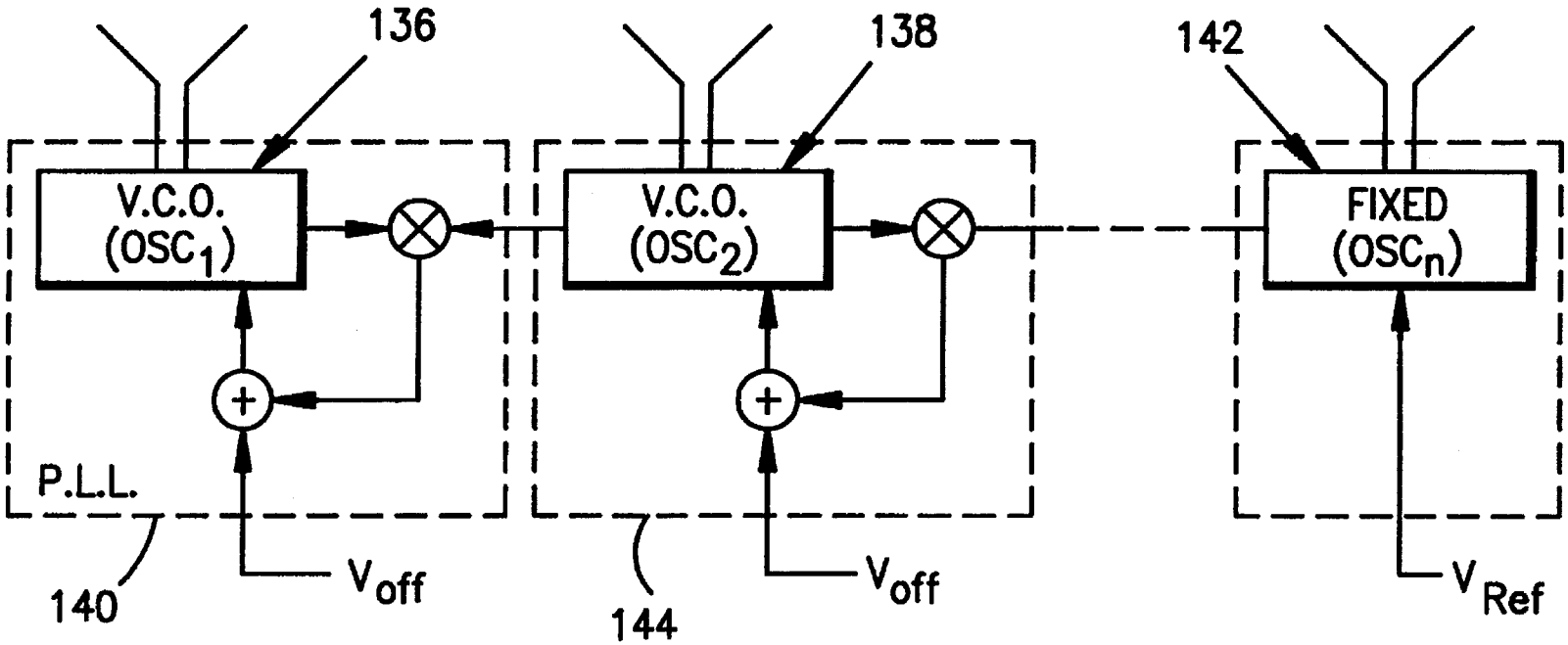
FIG. 6 is a diagrammatic illustration of a multiantenna array with a plurality of adjacent active circuits connected by corresponding phase-locked looped circuits.

Although the invention has been described above in terms of a pair of active antennas, the phase-locked loop circuit can be replicated to make a larger active array, as illustrated in FIG. 6. Thus, active antennas 136 and 138 may be connected by a phase-locked loop 140, as described above, and the active antenna 138 may be connected to another adjacent active antenna. This additional active antenna may include a variable controlled oscillator similar to VCO 136 or may incorporate a fixed oscillator such as that illustrated at 142. The VCO cooperates with the next adjacent phase locked loop 144 in the manner described above. When multiple control voltages are used in this manner, the fixed oscillator 142 provides the fixed frequency for the remaining active antennas, with these remaining antennas adjusting their phases to maintain the selected fixed frequency. A single control voltage $V_{off}$ can be utilized, or multiple control voltages can be provided for fine tuning.

Although the present invention has been described in terms of preferred embodiments, it will be apparent to those of skill in the art that variations and modifications may be made without departing from the true spirit and scope thereof as set forth in the accompanying claims.

What is claimed is:

1. Electronic beam steering apparatus comprising:

first and second spaced active antennas;

a first, reference oscillator having a first phase and driving said first antenna to produce a first transmitted RF beam at a first, fixed frequency and phase;

a second, tuning-voltage controlled, variable frequency oscillator having a second phase and driving said second antenna to produce a second transmitted RF beam at a frequency and phase determined by a tuning voltage supplied to said second oscillator;

a first, variable control voltage source; and a first phase-locked loop responsive to said first and second oscillators and to said control voltage source to produce a tuning voltage for varying the frequency of said second oscillator, said phase-locked loop responding to a variation in the frequency of said second oscillator to change the phase of said second oscillator with respect to the phase of said first oscillator to thereby change the phase relationship of said first and second RF beams for beam steering by varying said control voltage.

2. The apparatus of claim 1, wherein said phase-locked loop includes a first mixer responsive to said first and second oscillators to produce a difference voltage for varying the frequency of said second oscillator.

3. The apparatus of claim 2, wherein said phase-locked loop further includes a second mixer responsive to said difference voltage and said variable control voltage to produce said tuning voltage.

4. The apparatus of claim 3, wherein said first mixer comprises a pair of series-connected diodes.

5. The apparatus of claim 1, further including:

a third active antenna;

a third, tuning-voltage controlled, variable frequency oscillator having a third phase and driving said third antenna to produce a third transmitted RF beam, said third active antenna and third oscillator being connected between said first and second antennas.

6. The apparatus of claim 5, further including a second phase-locked loop responsive to said first and third oscillators, said first phase-locked loop being responsive to said second and third oscillators and to said first variable control-voltage source.

7. The apparatus of claim 6, further including a second variable control voltage source connected to said second phase-locked loop.

8. The beam steering apparatus of claim 1, further including first and second RF couplers for coupling said first and second oscillators, respectively, to said phase-locked loop.

9. The beam steering apparatus of claim 8, wherein said phase-locked loop includes a mixer connected to said first and second RF couplers for receiving RF signals from said first and second oscillators, said mixer having an output connected to control the frequency of oscillation of said second oscillator.

10. The beam steering apparatus of claim 9, wherein said first and second antennas and said first and second RF couplers are mounted on a microstrip substrate.

11. The beam steering apparatus of claim 10, wherein said first and second RF couplers are 90° couplers located adjacent corresponding first and second antennas.

12. The beam steering apparatus of claim 11, wherein said variable control voltage source is connected to modify the output of said mixer.

13. The beam steering apparatus of claim 1, wherein said first and second oscillators are connected directly to said corresponding first and second antennas.

14. The beam steering apparatus of claim 13, wherein each said antenna is coupled to said phase-locked loop.

* * * * *